US011264722B2

(12) United States Patent
Etani

(10) Patent No.: US 11,264,722 B2
(45) Date of Patent: Mar. 1, 2022

(54) ANTENNA

(71) Applicant: FURUNO ELECTRIC CO., LTD., Hyogo (JP)

(72) Inventor: Soichiro Etani, Minoh (JP)

(73) Assignee: FURUNO ELECTRIC CO., LTD., Hyogo (JP)

( * ) Notice: Subject to any disclaimer, the term of this patent is extended or adjusted under 35 U.S.C. 154(b) by 19 days.

(21) Appl. No.: 17/070,944

(22) Filed: Oct. 15, 2020

(65) Prior Publication Data

US 2021/0044025 A1 Feb. 11, 2021

Related U.S. Application Data

(63) Continuation of application No. PCT/JP2019/011325, filed on Mar. 19, 2019.

(30) Foreign Application Priority Data

Apr. 17, 2018 (JP) ..... JP2018-079058

(51) Int. Cl.
*H01Q 13/08* (2006.01)
*H01Q 13/24* (2006.01)
(Continued)

(52) U.S. Cl.
CPC ..... *H01Q 13/08* (2013.01); *H01Q 1/38* (2013.01); *H01Q 5/378* (2015.01); *H01Q 13/24* (2013.01)

(58) Field of Classification Search
CPC ..... H01Q 5/35; H01Q 9/045; H01Q 5/378; H01Q 1/38; H01Q 13/08; H01Q 13/24
See application file for complete search history.

(56) References Cited

U.S. PATENT DOCUMENTS 5,153,600 A 10/1992 Metzler et al.
5,410,323 A 4/1995 Kuroda
(Continued)

FOREIGN PATENT DOCUMENTS

CN 112602234 A * 4/2021 ..... H01Q 5/385
JP S63106206 7/1988
(Continued)

OTHER PUBLICATIONS

"International Search Report (Form PCT/ISA/210)" of PCT/JP2019/011325, dated May 7, 2019, with English translation thereof, pp. 1-2.

*Primary Examiner* — Graham P Smith
*Assistant Examiner* — Jae K Kim
(74) *Attorney, Agent, or Firm* — JCIPRNET

(57) ABSTRACT

An antenna is provided, including: a first substrate, having has a first and a second surfaces parallel to each other and having a dielectric; a second substrate, having a third and a fourth surfaces parallel to each other, the third surface being disposed to face and abut the second surface, having a dielectric; a first radiation conductor, formed on the first surface; a second radiation conductor, formed on the third surface; and a power supply, supplying power to the first and second radiation conductors. A position of the power supply is disposed from centers of the first and second radiation conductors by distance d. A distance between a position where a reflection loss with respect to the second high-frequency signal becomes the smallest and the centers is d0, d/d0 is equal to or larger than 4/3.

5 Claims, 5 Drawing Sheets

(51) Int. Cl.
*H01Q 1/38* (2006.01)
*H01Q 5/378* (2015.01)

(56) References Cited

U.S. PATENT DOCUMENTS

| | | | |
|---|---|---|---|
| 9,806,423 | B2 | 10/2017 | Panther et al. |
| 2009/0058731 | A1 | 3/2009 | Geary et al. |

FOREIGN PATENT DOCUMENTS

| | | | | | |
|---|---|---|---|---|---|
| JP | H0525805 | | | 4/1993 | |
| JP | H05211406 | | | 8/1993 | |
| JP | H05304413 | | | 11/1993 | |
| JP | H07288422 | A | * | 4/1994 | |
| JP | 3189565 | B2 | * | 7/2001 | |
| JP | WO2006004156 | A1 | * | 4/2008 | ..... H01Q 1/38 |
| JP | 5666729 | B1 | * | 2/2015 | |
| JP | 2017195433 | | | 10/2017 | |

* cited by examiner

D1:0.88-0.94≒0.91
D2:1.11-1.18≒1.15
D3:1.33-1.41≒1.37
D4:1.55-1.65≒1.60
D5:1.77-1.88≒1.82
D6:1.99-2.12≒2.05

Dc:0.92-0.97≒0.94

ANTENNA

CROSS-REFERENCE TO RELATED APPLICATION

The present application is a continuation of PCT/JP2019/011325, filed on Mar. 19, 2019 and is related to and claims priority from Japanese patent application no. 2018-079058, filed on Apr. 17, 2018. The entire contents of the aforementioned application are hereby incorporated by reference herein.

BACKGROUND

Technical Field

The present disclosure relates to an antenna that receives a high-frequency signal having a plurality of frequencies.

Related Art

In the related art, various kinds of antennas for a global navigation satellite system (GNSS) have been devised. In antennas for a GNSS, when a global positioning system (GPS) is employed as a GNSS, for example, it is required to receive a plurality of frequencies, such as a combination of an L1 wave and an L2 wave.

For example, as an antenna for a GNSS, Patent Literature 1 (Japanese Patent Application Laid-Open No. 2017-195433) discloses a multi-layered antenna in which a plurality of patch antennas having different receiving frequencies is laminated.

However, in the multi-layered antenna disclosed in Patent Literature 1, reception characteristics (a gain and a frequency bandwidth) required for a high-frequency signal having a plurality of frequencies may not be able to be satisfied without changing the external shape.

Therefore, the present disclosure is to realize an antenna having exceptional reception characteristics without changing the external shape.

SUMMARY

According to this disclosure, there is provided an antenna including a first substrate, a second substrate, a first radiation conductor, a second radiation conductor, and a power supply. The first substrate has a first surface and a second surface parallel to each other. The first substrate includes a dielectric. The second substrate has a third surface and a fourth surface parallel to each other. In the second substrate, the third surface is disposed in a manner of facing and abutting the second surface. The second substrate includes a dielectric. The second substrate has an external shape the same as the first substrate in a plan view. The first radiation conductor is formed on the first surface and has a shape corresponding to a first high-frequency signal using a first frequency band. The second radiation conductor is formed on the third surface and has a shape corresponding to a second high-frequency signal using a second frequency band that is a broadband having a lower frequency than the first frequency band. The power supply supplies power to the first radiation conductor and the second radiation conductor. A position where the power supply is disposed is a position at a distance of d from centers of the first radiation conductor and the second radiation conductor. When a distance between a position where a reflection loss with respect to the second high-frequency signal becomes the smallest and the centers is d0, d/d0 is equal to or larger than 4/3.

In this configuration, a 3 dB bandwidth with respect to the second high-frequency signal can be widened.

According to this disclosure, exceptional reception characteristics can be realized without changing the external shape.

DESCRIPTION OF EMBODIMENT

Figure 1:
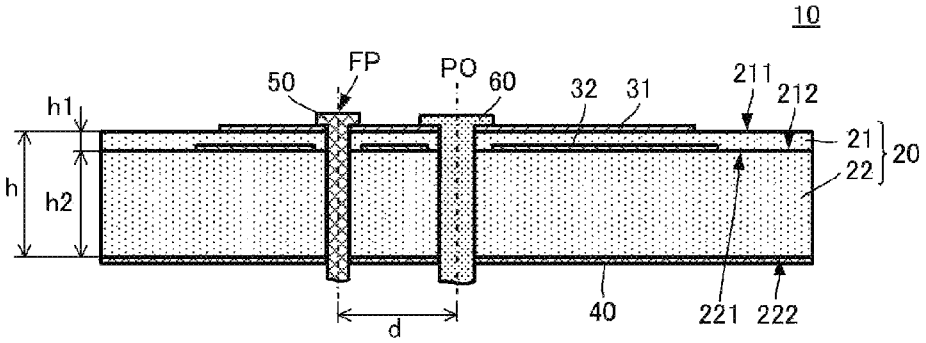
FIG. 1 is a side surface cross-sectional view showing a configuration of an antenna according to an embodiment of the present disclosure.
Figure 2:
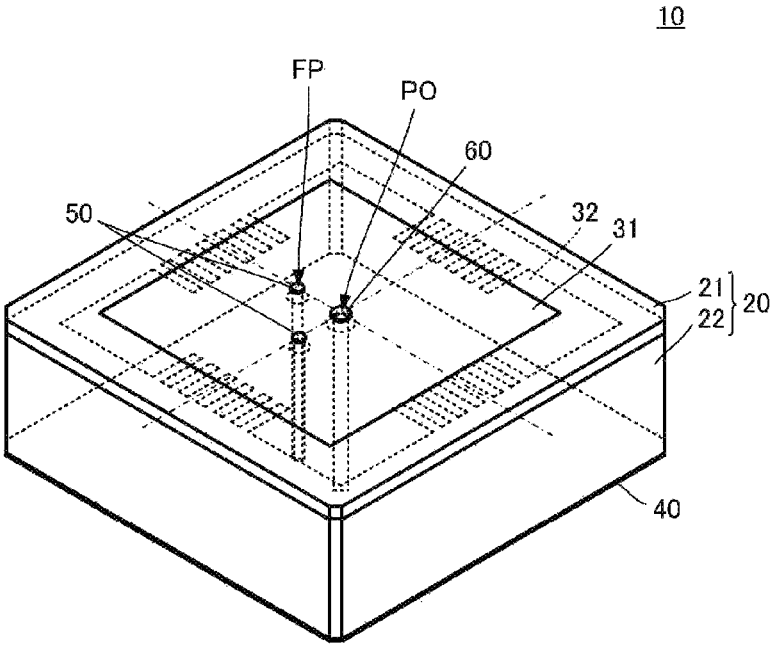
FIG. 2 is a perspective view of an appearance of the antenna according to the embodiment of the present disclosure.
Figure 3:
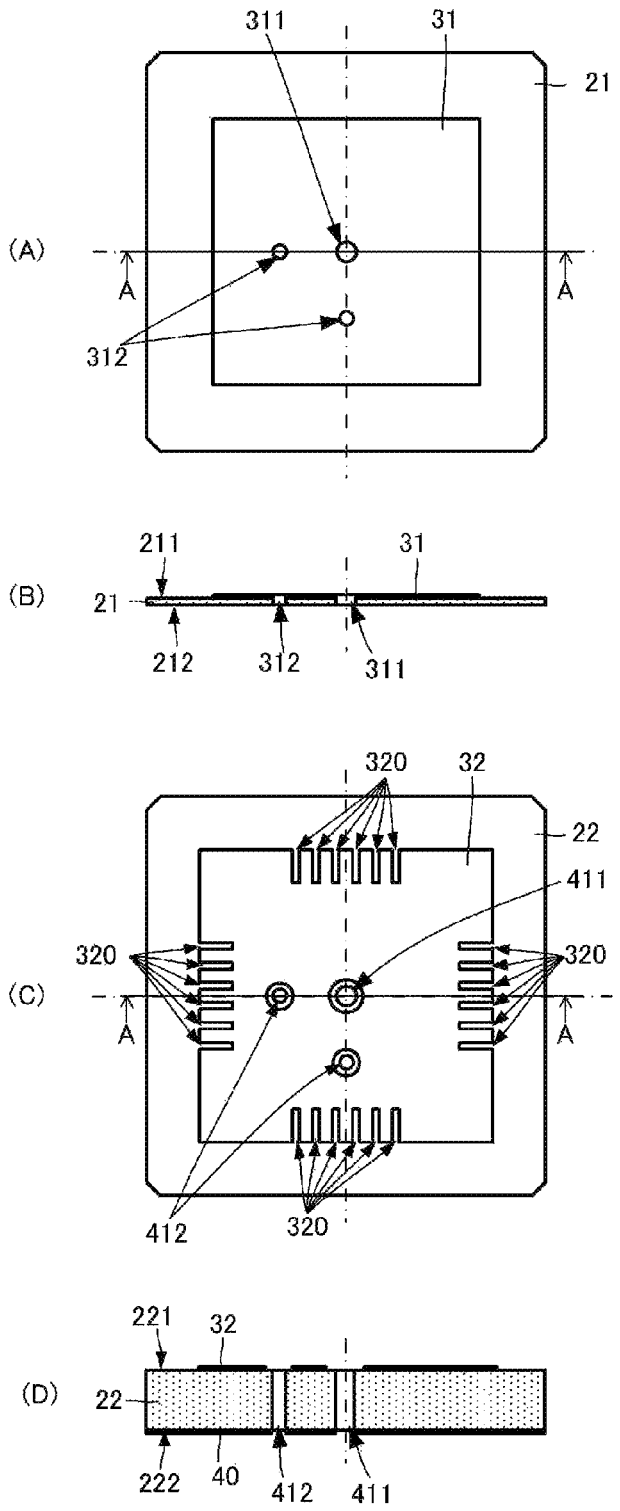
FIG. 3 shows an antenna according to the embodiment, in which (A) is a plan view of a first substrate, (B) is a side surface cross-sectional view (cross-sectional view along A-A) of the first substrate, (C) is a plan view of a second substrate, and (D) is a side surface cross-sectional view (cross-sectional view along A-A) of the second substrate.

An antenna according to an embodiment of the present disclosure will be described with reference to the drawings. FIG. 1 is a side surface cross-sectional view showing a configuration of the antenna according to the embodiment of the present disclosure. FIG. 2 is a perspective view of an appearance of the antenna according to the embodiment of the present disclosure. FIG. 3 shows an antenna according to the embodiment, in which (A) is a plan view of a first substrate, (B) is a side surface cross-sectional view (cross-sectional view along A-A) of the first substrate, (C) is a plan view of a second substrate, and (D) is a side surface cross-sectional view (cross-sectional view along A-A) of the second substrate.

As shown in FIGS. 1 and 2, an antenna 10 includes a substrate 20, a radiation conductor 31, a radiation conductor 32, a ground conductor 40, power supplies 50, and a fixing member 60. The substrate 20 includes a first substrate 21 and a second substrate 22. The radiation conductor 31 corresponds to "a first radiation conductor" of the present disclosure, and the radiation conductor 32 corresponds to "a second radiation conductor" of the present disclosure.

As shown in FIGS. 1, 2, 3, the first substrate 21 and the second substrate 22 are flat plates. For example, the first substrate 21 and the second substrate 22 are composed of a dielectric such as a ceramic.

The first substrate 21 has a main surface 211 and a main surface 212 facing each other. The main surface 211 corresponds to "a first main surface" of the present disclosure, and the main surface 212 corresponds to "a second main surface" of the present disclosure.

The second substrate 22 has a main surface 221 and a main surface 222 facing each other. The main surface 221 corresponds to "a third main surface" of the present disclosure, and the main surface 222 corresponds to "a fourth main surface" of the present disclosure. The first substrate 21 and the second substrate 22 have the same shape in a plan view.

The first substrate 21 and the second substrate 22 are laminated in a manner of overlapping each other. At this time, the main surface 212 of the first substrate 21 and the main surface 221 of the second substrate 22 face and abut each other.

A thickness h1 of the first substrate 21 is smaller than a thickness h2 of the second substrate 22. More specifically, a relationship $0<(h1/h2)\leq(3/7)$ is satisfied.

The radiation conductor 31 is formed on the main surface 211 of the first substrate 21. The radiation conductor 31 has a substantially rectangular shape. The radiation conductor 31 is formed of a metal or the like having high conductivity.

The shape of the radiation conductor 31, specifically, the dimension or the like of each side of the rectangular shape is determined in accordance with a frequency (wavelength) of a high-frequency signal received by the radiation conductor 31. A high-frequency signal received by this radiation conductor 31 corresponds to "a first high-frequency signal" of the present disclosure, and this frequency band corresponds to "a first frequency band". When the antenna 10 is used for receiving in a GPS, a high-frequency signal (first high-frequency signal) received by the radiation conductor 31 is an L1 wave, and the frequency is 1575.42 MHz. Therefore, the first frequency band is a band having a predetermined frequency width including the frequency of 1575.42 MHz.

The radiation conductor 32 is formed on the main surface 221 of the second substrate 22. The radiation conductor 32 has a substantially rectangular shape. A flat surface area of the radiation conductor 32 is larger than a flat surface area of the radiation conductor 31. In a plan view, the center of the radiation conductor 32 and the center of the radiation conductor 31 coincide with each other. A plurality of slits is formed at each side of the radiation conductor 32. The plurality of slits has a shape extending from each side in a direction to the center. The radiation conductor 32 is formed of a metal or the like having high conductivity.

The shape of the radiation conductor 32, specifically, the dimension or the like of each side of the rectangular shape is determined in accordance with a frequency (wavelength) of a high-frequency signal received by the radiation conductor 32. A high-frequency signal received by this radiation conductor 32 corresponds to "a second high-frequency signal" of the present disclosure, and this frequency band corresponds to "a second frequency band". When the antenna 10 is used for receiving in a GPS, a high-frequency signal (second high-frequency signal) received by the radiation conductor 32 is an L2 wave, an L5 wave, and an L6 wave, and the frequencies are 1227.60 MHz, 1176.45 MHz, and 1278.75 MHz, respectively. Therefore, the second frequency band is a band having a predetermined frequency width including the frequencies of 1227.60 MHz, 1176.45 MHz, and 1278.75 MHz.

The ground conductor 40 is formed on the main surface 222 of the substrate 22. The ground conductor 40 is formed on substantially the entire surface of the main surface 222. The ground conductor 40 overlaps the radiation conductor 31 and the radiation conductor 32 in a plan view, and the area thereof is larger than the area of the radiation conductor 31 and the area of the radiation conductor 32. An insulating circuit board may be disposed on the main surface 222 side of the substrate 22, and the ground conductor 40 may be disposed on this circuit board (for example, on a rear surface (a surface on a side opposite to the substrate 22 side)).

The power supplies 50 are composed of a rod-shaped conductor. The power supplies 50 penetrate the substrate 21 and the substrate 22. The power supplies 50 are directly connected to the radiation conductor 31, and the power supplies 50 are capacitively coupled to the radiation conductor 32. The power supplies 50 are not connected to the ground conductor 40. The power supplies 50 are disposed at positions at a distance d from centers PO thereof in a plan view of the radiation conductor 31 and the radiation conductor 32. That is, as shown in FIG. 1, a distance between power supply points FP and the centers PO becomes d. Two power supplies 50 are disposed, and a direction in which one power supply 50 and the center are connected to each other and a direction in which the other power supply 50 and the center are connected to each other are orthogonal to each other.

Further, the distance d satisfies a relationship $(d/d0)\geq(4/3)$. Here, d0 indicates a distance between the center PO and the power supply point when a reflection loss of the second high-frequency signal has the smallest value. More specifically, the distance is determined based on a range including positions where the reflection loss has the smallest value with respect to each of the plurality of high-frequency signals (for example, the L2 wave, the L5 wave, and the L6 wave in the example described above) included in the second high-frequency signal. As an example, the smallest value of the reflection loss is −30 dB, for example, and this smallest value can be suitably set in accordance with the specifications of the antenna 10 and the specifications of a GNSS receiving device to which the antenna 10 is connected. In addition, the largest value of d indicates the longest length (the distance from the centers of the radiation conductor 31 and the radiation conductor 32) in which the power supplies 50 can supply power to the radiation conductor 31 and the radiation conductor 32, and it can be set to a predetermined value equal to or smaller than the radius of the radiation conductor 31 or the radiation conductor 32, for example.

According to this configuration, the antenna 10 receives the first high-frequency signal (for example, the L1 wave) using the radiation conductor 31 and receives the second high-frequency signal (for example, the L2 wave, the L5 wave, and the L6 wave) having a lower frequency than the first high-frequency signal using the radiation conductor 32.

Further, when the distance between the power supply point and the center has the relationship $((d/d0)\geq(4/3))$ described above, reception characteristics of the antenna 10 are improved.

Figure 4:
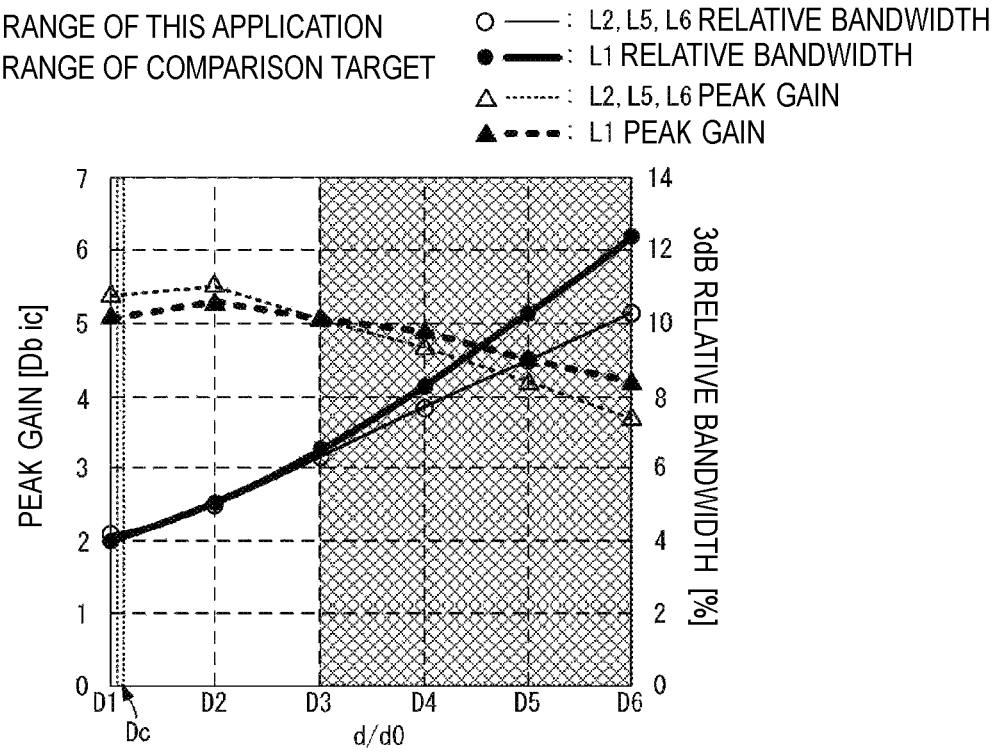
FIG. 4 is a graph showing a relationship between a peak gain and a 3 dB relative bandwidth, and a distance from a center to a power supply point.

FIG. 4 is a graph showing a relationship between a peak gain and a 3 dB relative bandwidth, and the distance from the center to the power supply point. FIG. 4 shows the peak gain and the 3 dB relative bandwidth of the L1 wave, that is, the peak gain and the 3 dB relative bandwidth of the first high-frequency signal, and the peak gains and the 3 dB relative bandwidths of the L2 wave, the L5 wave, and the L6 wave, that is, the peak gain and the 3 dB relative bandwidth of the second high-frequency signal. In addition, the horizontal axis in FIG. 4 discretely sets the range of the distance to the power supply point.

As shown in FIG. 4, according to the configuration (the configuration of the disclosure in this application) in which d/d0 is larger than D3 (1.33 to 1.41), for example, compared to a configuration (a configuration of a general antenna (comparison target) in the related art) in which d/d0 is approximately Dc (0.92 to 0.97), it is possible to obtain a peak gain equivalent to that of the configuration of the general antenna in the related art with respect to the L1 wave. That is, when (d/d0)≥(4/3) is established, deterioration in peak gain with respect to the L1 wave can be curbed.

Moreover, according to the configuration of the disclosure in this application, compared to the configuration of the general antenna in the related art, the 3 dB relative bandwidths with respect to the L2 wave, the L5 wave, and the L6 wave can be widened. In addition, also in the configuration of the disclosure in this application, it is possible to obtain a peak gain equivalent to that of the configuration of the general antenna in the related art with respect to the L2 wave, the L5 wave, and the L6 wave. That is, when (d/d0)≥(4/3) is established, while the 3 dB relative bandwidths with respect to the L2 wave, the L5 wave, and the L6 wave are widened, deterioration in peak gain can be curbed.

In this manner, when the antenna 10 is used, deterioration in peak gain with respect to the L1 wave is curbed.

In addition, when the antenna 10 is used, with respect to the frequency band (second frequency band) including the frequency bands of the L2 wave, the L5 wave, and the L6 wave having a wide bandwidth, the 3 dB relative bandwidth having an extent corresponding to this bandwidth can be realized, and reception characteristics can be improved. Accordingly, reception sensitivity with respect to the L2 wave, the L5 wave, and the L6 wave can be improved. In addition, according to this configuration, since deterioration in peak gain is curbed, the antenna 10 has exceptional reception characteristics with respect to the L2 wave, the L5 wave, and the L6 wave.

Therefore, the antenna 10 has exceptional reception characteristics with respect to a plurality of types of high-frequency signals, specifically, the L1 wave, the L2 wave, the L5 wave, and the L6 wave in the present embodiment.

In addition, when the thickness h1 of the substrate 21 and the thickness h2 of the substrate 22 have the relationship (0<(h1/h2)≤(3/7)) described above, reception characteristics of the antenna 10 are improved.

Figure 5:
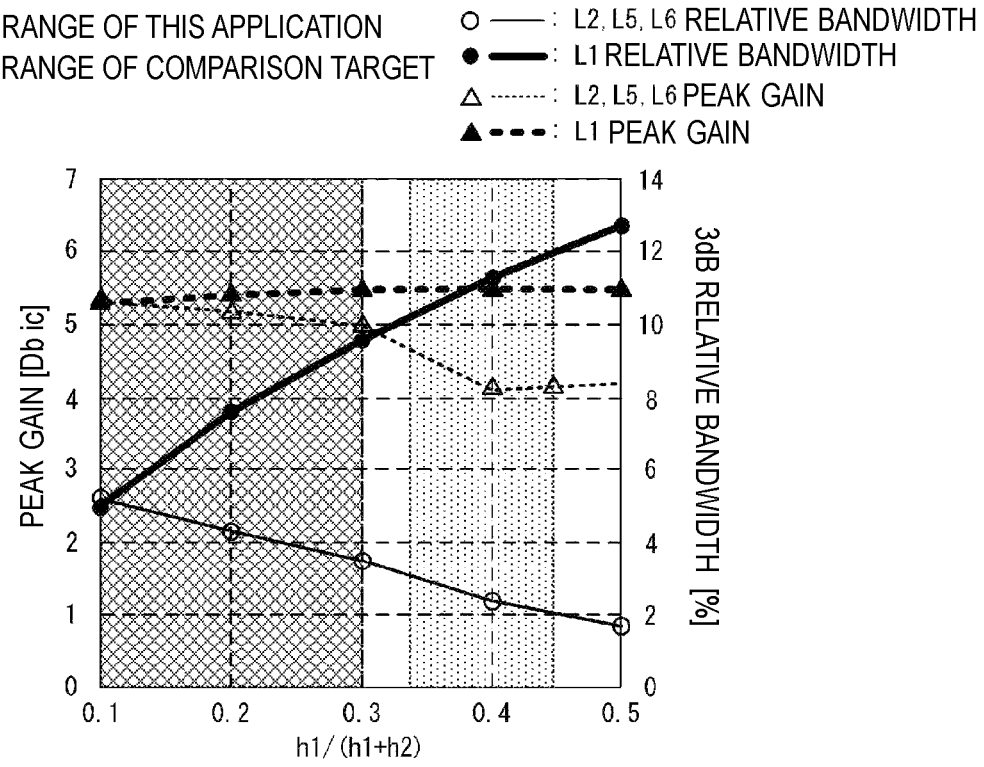
FIG. 5 is a graph showing a relationship between the peak gain and the 3 dB relative bandwidth, and a thickness of the substrate.

FIG. 5 is a graph showing a relationship between the peak gain and the 3 dB relative bandwidth, and the thickness of the substrate. FIG. 5 shows the peak gain and the 3 dB relative bandwidth of the L1 wave, that is, the peak gain and the 3 dB relative bandwidth of the first high-frequency signal, and the peak gains and the 3 dB relative bandwidths of the L2 wave, the L5 wave, and the L6 wave, that is, the peak gain and the 3 dB relative bandwidth of the second high-frequency signal. The simulation in FIG. 4 is performed with the same total thickness of the substrates (h (h1+h2), that is, the sum of the first substrate and the second substrate) in both the configuration in this application and the comparative configuration in the related art.

As shown in FIG. 5, according to the configuration (the configuration of the disclosure in this application) in which h1/(h1+h2) is smaller than 0.3, for example, compared to the configuration in which h1/(h1+h2) is approximately 0.4 (the configuration of the general antenna (comparison target) in the related art), it is possible to narrow the 3 dB relative bandwidth with respect to the L1 wave. On the other hand, also in the configuration of the disclosure in this application, it is possible to obtain a peak gain equivalent to that of the configuration of the general antenna in the related art with respect to the L1 wave. That is, when 0<(h1/h2)≤(3/7) is established, while the 3 dB relative bandwidth with respect to the L1 wave is narrowed, deterioration in peak gain can be curbed.

Moreover, according to the configuration of the disclosure in this application, compared to the configuration of the general antenna in the related art, the 3 dB relative bandwidths with respect to the L2 wave, the L5 wave, and the L6 wave can be widened. In addition, also in the configuration of the disclosure in this application, it is possible to obtain a peak gain equivalent to or larger than that of the configuration of the general antenna in the related art with respect to the L2 wave, the L5 wave, and the L6 wave. That is, when 0<(h1/h2)≤(3/7) is established, while the 3 dB relative bandwidths with respect to the L2 wave, the L5 wave, and the L6 wave are widened, the peak gain can be improved.

In this manner, when the antenna 10 is used, it is possible to improve reception characteristics in which the 3 dB relative bandwidth with respect to the frequency band (first frequency band) of the L1 wave having a narrow bandwidth is unnecessarily widened. Accordingly, reception of unnecessary waves with respect to the L1 wave can be curbed, and reception sensitivity with respect to the L1 wave can be improved practically. In addition, according to this configuration, since deterioration in peak gain is curbed, the antenna 10 has exceptional reception characteristics with respect to the L1 wave.

In addition, when the antenna 10 is used, with respect to the frequency band (second frequency band) including the frequency bands of the L2 wave, the L5 wave, and the L6 wave having a wide bandwidth, the 3 dB relative bandwidth having an extent corresponding to this bandwidth can be realized, and reception characteristics can be improved. Accordingly, reception sensitivity with respect to the L2 wave, the L5 wave, and the L6 wave can be improved. In addition, according to this configuration, since the peak gain is improved, the antenna 10 has exceptional reception characteristics with respect to the L2 wave, the L5 wave, and the L6 wave.

Therefore, the antenna 10 has exceptional reception characteristics with respect to a plurality of types of high-frequency signals, specifically, the L1 wave, the L2 wave, the L5 wave, and the L6 wave in the present embodiment.

Figure 6:
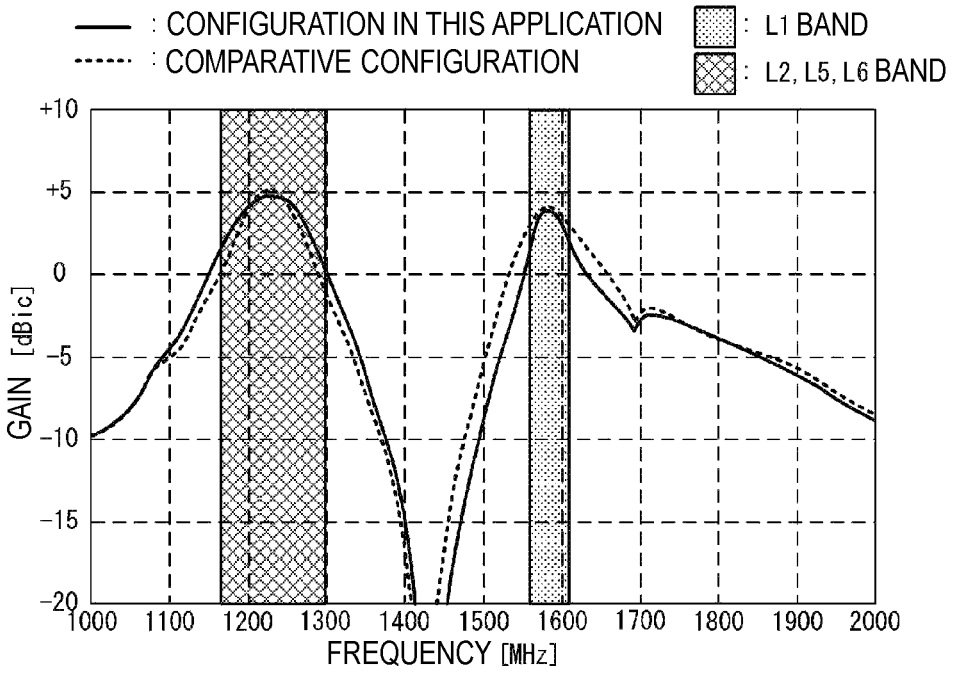
FIG. 6 is a graph showing frequency characteristics of gains of the antenna according to the present embodiment and an antenna which is a comparison target.

FIG. 6 is a graph showing frequency characteristics of gains of the antenna according to the present embodiment and an antenna which is a comparison target.

As shown in FIG. 6, when the configuration of the antenna 10 according to the present embodiment is used, a situation in which the 3 dB relative bandwidth with respect to the L1 wave having a narrow bandwidth is unnecessarily widened can be curbed, and the 3 dB relative bandwidths with respect to the L2 wave, the L5 wave, and the L6 wave having a wide bandwidth can be widened in accordance with the frequency bands of the L2 wave, the L5 wave, and the L6 wave. In addition, when the configuration of the antenna 10 is used, deterioration in gain with respect to the L1 wave, the L2 wave, the L5 wave, and the L6 wave can be curbed.

Accordingly, the antenna 10 can realize exceptional reception characteristics with respect to the L1 wave, the L2 wave, the L5 wave, and the L6 wave. Moreover, the external shape of the antenna 10 is not changed in order to realize these reception characteristics. Therefore, the antenna 10 can realize exceptional reception characteristics with respect to the L1 wave, the L2 wave, the L5 wave, and the L6 wave without changing the external shape.

The reception characteristics described above can be improved in no small way by employing any one of the condition for the thickness of the substrate and the condition for the distance between the power supply point and the center described above. Particularly, it is easy to improve the reception characteristics described above by satisfying the condition for the position of the power supply point.

In addition, in the foregoing description, a GPS has been described as an example, but it is possible to obtain similar operational effects by applying a similar configuration to each system of other GNSSs.

In addition, in the foregoing description, the radiation conductors have a substantially rectangular shape, but the shape thereof is not limited to a substantially rectangular shape. For example, the shape need only be a shape capable of radiating (transmitting and receiving) a high-frequency signal composed of circularly polarized waves having a desired frequency, such as a substantially circular shape.

Terms

All the objectives or the effects and advantages are not necessarily able to be achieved in accordance with any particular embodiment disclosed in this specification. Therefore, for example, those skilled in the art will appreciate that a particular embodiment can be configured to be able to operate such that one or a plurality of effects and advantages instructed in this specification can be achieved or optimized without necessarily achieving other objectives or effects and advantages instructed or suggested in this specification.

All the steps of processing disclosed in this specification can be realized and automated completely using a software code module which is executed by a computing system including one or a plurality of computers or processors. The code module can be stored in a non-transitory computer readable medium of an arbitrary type or a different computer storage device. Some or the entirety of a method can be realized using dedicated computer hardware.

It is apparent from the present disclosure that there are many other alteration examples in addition to those disclosed in this specification. For example, in accordance with the embodiment, any particular operation, event, or function of the algorithms disclosed in this specification can be executed in a different sequence and can be added, combined, or completely excluded (for example, all the behaviors or phenomena described above are not necessary to execute the algorithms). Moreover, in a particular embodiment, operations or events can be executed in parallel, instead of being executed successively, via multithread processing, interruption processing, a plurality of processors or processor cores, for example, or on a different parallel architecture. Moreover, different tasks or processes can also be executed by different machines and/or computing systems which can function together.

Various exemplary logical blocks and modules which have been described in connection with the embodiment disclosed in this specification can be performed or executed by a machine such as a processor. The processor may be a micro-processor. Alternatively, the processor may be a controller, a micro-controller, a state machine, a combination thereof, or the like. The processor can include an electric circuit configured to perform processing of a computer executable command. In another embodiment, the processor includes an application-specific integrated circuit (ASIC), a field programmable gate array (FPGA), or other programmable devices executing a logical operation without performing processing of a computer executable command. In addition, the processor can be mounted as a combination of a computing device, for example, a combination of a digital signal processor (digital signal processing device) and a micro-processor, a plurality of micro-processors, one or more micro-processors combined with a DSP core, or other arbitrary configurations thereof. In this specification, description will be given mainly in connection with a digital technology, but the processor can mainly include an analog element as well. For example, some or all of the signal processing algorithms disclosed in this specification can be mounted using an analog circuit or an analog/digital mixed circuit. A computing environment includes a micro-processor, a main frame computer, a digital signal processor, a portable computing device, a device controller, or a computer system on the basis of a computational engine inside a device, but it can include a computer system of an arbitrary type which is not limited to these.

Unless otherwise specified, conditional language such as "can be", "could be", "will be", and "have a possibility" is understood in the sense within contexts which are generally used for conveying that a particular embodiment includes a particular feature, a particular element, and/or a particular step but other embodiments do not include these. Therefore, generally, such conditional language does not mean that a feature, an element, and/or a step is an arbitrary method required for one or more embodiments, or one or more embodiments necessarily include a logic for determining whether the feature, the element, and/or the step is included in any particular embodiment or executed.

Unless otherwise disclosed, disjunctive language such as a phrase "at least one of X, Y, and Z" is understood as a context which is generally used for indicating that an item, a term, and the like can be any of X, Y, and Z or an arbitrary combination thereof (example: X, Y, and Z). Therefore, generally, such disjunctive language does not mean that a particular embodiment requires each of at least one of X, at least one of Y, and at least one of Z which exist individually.

Description of an arbitrary process, an arbitrary element, or an arbitrary block in a flowchart disclosed in this specification and/or shown in the accompanying drawings should be understood as a factor including one or more executable commands for mounting a particular logic function or a particular element in a process and potentially expressing a part of a module, a segment, or a code. An alternative embodiment is included within the scope of the embodiment disclosed in this specification. Here, as understood by those skilled in the art, elements or functions can be deleted practically at the same time or in a reverse order in accordance with related functionality from those which have been illustrated or described or can be executed in a random order.

Unless otherwise specified, generally, numerals such as "one" should be interpreted such that one or more of the described items are included. Therefore, a phrase such as "one device which is set to perform something" means that one or more of the enumerated devices are included. One or a plurality of such enumerated devices can also be collectively configured such that the disclosed citation is executed. For example, "a processor configured to execute the following A, B and C" can include a first processor which is configured to execute A and a second processor which is configured to execute B and C. Furthermore, even if specific numbers of an introduced example are expressly enumerated, they should be interpreted by those skilled in the art such that such enumeration typically means at least the enumerated numbers (for example, simple enumeration such as "enumeration of two items" without any other modifiers generally means enumeration of at least two items or enumeration of two or more items).

Generally, it is judged by those skilled in the art that the terms used in this specification are intended to be "unrestricted" terms (for example, a term such as "include something" should be generally interpreted as "include not only that but also at least something", a term such as "have something" should be interpreted as "have at least something", and a term such as "include" should be interpreted as "include the following but the configuration is not limited thereto").

The term "horizontal" used in this specification for the purpose of description is defined as a flat surface of a floor or a flat surface parallel to a front surface thereof in a region in which a described system is used, or a flat surface on which a described method is performed regardless of the direction thereof. A term such as "a floor" can be replaced with a term such as "a ground surface" or "a water surface". A term such as "perpendicular/vertical" indicates a direction which is perpendicular/vertical to a defined horizontal line. Terms such as "upper side", "lower side", "down", "up", "side surface", "higher than", "lower than", "upward", "beyond", and "below" are defined with respect to a horizontal surface.

Unless otherwise noted, terms such as "adhere", "connect", and "in a pair" used in this specification and other related terms should be interpreted such that the terms connote connection or joining in a manner of being movable, fixable, adjustable, and/or detachable. A term connection/joining connotes direct connection and/or connection having an intermediate structure between two constituent elements which have been described.

Unless otherwise specified, numbers having an antecedent term such as "nearly", "approximately", or "practically" used in this specification include enumerated numbers and also indicate amounts close to the disclosed amounts for further executing a desired function or achieving a desired result. For example, unless otherwise specified, "nearly", "approximately", and "practically" denote a value less than 10% of the disclosed numerical value. As used in this specification, the feature of the embodiment in which the term such as "nearly", "approximately", or "practically" is disclosed as an antecedent indicates a feature having some variabilities for further executing a desired function or achieving a desired result regarding the feature.

In the foregoing embodiment, many alteration examples and modification examples can be added, and elements thereof should be understood such that they are involved in other acceptable examples. All those modifications and alterations are intended to be included within the scope of the present disclosure and are protected by the following CLAIMS.

What is claimed is:

1. An antenna, comprising:

a first substrate which has a first surface and a second surface parallel to each other and includes a dielectric;

a second substrate which has a third surface and a fourth surface parallel to each other, in which the third surface is disposed in a manner of facing and abutting the second surface, which includes a dielectric, and which has an external shape the same as the first substrate in a plan view;

a first radiation conductor which is formed on the first surface and has a shape corresponding to a first high-frequency signal using a first frequency band;

a second radiation conductor which is formed on the third surface and has a shape corresponding to a second high-frequency signal using a second frequency band that is a broadband having a lower frequency than the first frequency band; and a power supply which supplies power to the first radiation conductor and the second radiation conductor, wherein a position where the power supply is disposed is a position at a distance of d from centers of the first radiation conductor and the second radiation conductor, and when a distance between a position where a reflection loss with respect to the second high-frequency signal becomes the smallest and the centers is d0, d/d0 is equal to or larger than 4/3.

2. The antenna according to claim 1, wherein the second high-frequency signal includes a plurality of types of high-frequency signals, and a position where the reflection loss has a smallest value is determined based on a range including positions where the reflection loss has the smallest value with respect to each of the plurality of types of high-frequency signals.

3. The antenna according to claim 1, wherein a thickness of the first substrate is equal to or smaller than 3/7 times a thickness of the second substrate.

4. The antenna according to claim 3, wherein the second high-frequency signal includes a plurality of types of high-frequency signals, and a position where the reflection loss has a smallest value is determined based on a range including positions where the reflection loss has the smallest value with respect to each of the plurality of types of high-frequency signals.

5. An antenna comprising:

a first substrate which has a first surface and a second surface parallel to each other and includes a dielectric;

a second substrate which has a third surface and a fourth surface parallel to each other, in which the third surface is disposed in a manner of facing and abutting the second surface, which includes a dielectric, and which has an external shape the same as the first substrate in a plan view;

a first radiation conductor which is formed on the first surface and has a shape corresponding to a first high-frequency signal using a first frequency band;

a second radiation conductor which is formed on the third surface and has a shape corresponding to a second high-frequency signal using a second frequency band that is a broadband having a lower frequency than the first frequency band; and a power supply which supplies power to the first radiation conductor and the second radiation conductor, wherein a thickness of the first substrate is equal to or smaller than 3/7 times a thickness of the second substrate.

* * * * *